US006974060B2

(12) United States Patent
Gomes et al.

(10) Patent No.: US 6,974,060 B2
(45) Date of Patent: Dec. 13, 2005

(54) MULTIPLE ROLL TAPE DISPENSER

(75) Inventors: Francis Gomes, Jersey City, NJ (US); David Landsberger, Caldwell, NJ (US); Paul Thom, Clifton, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 1 day.

(21) Appl. No.: 10/389,950

(22) Filed: Mar. 18, 2003

(65) Prior Publication Data

US 2004/0182905 A1 Sep. 23, 2004

(51) Int. Cl.[7] ..... B26F 3/02; B65H 35/07

(52) U.S. Cl. ..... 225/34; 225/25; 225/42; 225/47; 225/77; 83/650; 242/594.3; 242/598.3

(58) Field of Search ..... 225/34, 35, 47, 225/25, 42, 44, 45, 46, 77, 80; 83/649, 650, 83/922, 924, 949, 950; 242/594.3, 598.3

(56) References Cited

U.S. PATENT DOCUMENTS

| | | | | | |
|---|---|---|---|---|---|
| 840,702 | A | * | 1/1907 | Maloney | 242/598.4 X |
| 1,215,388 | A | * | 2/1917 | Lanford | 83/614 |
| 2,304,312 | A | * | 12/1942 | Meglitz | 225/47 |
| 2,352,445 | A | | 6/1944 | Pinckney | 225/34 X |
| 2,456,660 | A | * | 12/1948 | Werner | 225/47 X |
| 2,708,076 | A | | 5/1955 | Polster et al. | 225/34 |
| 2,961,736 | A | | 11/1960 | Kier | 225/34 X |
| 3,006,570 | A | * | 10/1961 | Boser | 242/578 |
| 3,152,739 | A | * | 10/1964 | McWilliams | 225/46 |
| 3,176,892 | A | * | 4/1965 | Waltz | 225/66 |
| 3,193,433 | A | | 7/1965 | Tillotson | 225/34 X |
| 3,672,550 | A | | 6/1972 | Greco | 225/34 |
| 3,768,713 | A | | 10/1973 | Lash | 225/34 |
| 4,151,039 | A | | 4/1979 | Lash | 156/584 |
| 4,252,258 | A | | 2/1981 | Plummer, III | 225/25 |
| 4,645,107 | A | * | 2/1987 | Norris | 225/47 X |
| 4,685,633 | A | * | 8/1987 | Pellini | 242/598.3 |
| 4,735,351 | A | | 4/1988 | Biswas | 225/25 |
| 5,011,059 | A | * | 4/1991 | Jennings et al. | 225/47 X |
| 5,207,368 | A | * | 5/1993 | Wilfong et al. | 225/46 X |
| 5,598,985 | A | * | 2/1997 | Winesett | 242/395 |
| 5,692,625 | A | * | 12/1997 | Filipescu et al. | 242/598.3 X |
| 5,704,564 | A | * | 1/1998 | Neiderman | 242/527.5 |
| D399,257 | S | | 10/1998 | Tang et al. | D19/69 |
| 6,418,995 | B1 | | 7/2002 | Sadrakula et al. | 156/510 |

FOREIGN PATENT DOCUMENTS

| | | |
|---|---|---|
| DE | 197 22 727 A | 12/1998 |
| EP | 0 963 933 A | 12/1999 |
| EP | 1 107 263 A | 6/2001 |

OTHER PUBLICATIONS

Bel-Art Catalog No. 198, pp. 186-191, Jan. 1998.

* cited by examiner

*Primary Examiner*—Clark F. Dexter
(74) *Attorney, Agent, or Firm*—Lawrence G. Fridman

(57) ABSTRACT

A multiple roll tape dispenser consists of a spool unit and a spool housing assembly. The spool unit consists of a first end cap connected to a second end cap by at least one inner tape roll supporting cross member for rotatably supporting a first tape roll having a first inner diameter and a plurality of outer tape roll supporting cross members for rotatably supporting a second tape roll having a second inner diameter being greater than the inner diameter of the first tape roll.

18 Claims, 11 Drawing Sheets

MULTIPLE ROLL TAPE DISPENSER

FIELD OF THE INVENTION

The present invention relates to multiple roll tape dispensers, and more particularly, to a tape dispensing system capable of simultaneously accommodating a plurality of tape rolls of varying dimensions.

BACKGROUND OF THE INVENTION

A typical roll of tape includes a length of tape having an inner tape surface coated with a pressure sensitive adhesive and an outer peripheral tape surface. The length of tape is wrapped around a hollow core, wherein the hollow core defines an inner diameter of the tape roll and the outer peripheral tape surface defines an outer diameter of the tape roll. Rolls of tape come in a variety of shapes and sizes depending upon the length and width of the tape and the diameter of the hollow core.

For nearly every size and shape of tape roll there is a tape dispenser for dispensing varied lengths of tape. In certain situations, however, it is desirable to simultaneously dispense multiple rolls of tape from a single tape dispenser. Various prior art multiple roll tape dispensing systems exist and are effective in dispensing rolls of tape having similar dimensions. However, such dispensers often are not capable of accommodating multiple tape rolls having varying dimensional characteristics, such as varying inner diameters.

The roll tape dispensers of the prior art generally suffer from one or more drawbacks and limitations that oftentimes render them undesirable or unsuitable for a specific use. Generally, these drawbacks and limitations stem from the device structure. By way of example, U.S. Pat. No. 4,735,351 discloses a multiple roll tape dispenser incorporating a relatively complex framework structure. It would be obvious that manufacture of such device is laborious, time consuming and therefore expensive. Furthermore, this device is generally unsuitable for dispensing of rolls of tape having varying inner diameters as well as varying widths. U.S. Pat. Nos. 2,708,076; 3,672,550 and 3,768,713 also provide multiple tape dispensers. However, none of these patents disclose a tape dispenser capable of accommodating tape rolls having varying characteristics, such as varying inner diameter.

Accordingly, there is a well-established need for a tape dispenser that avoids the drawbacks and limitations of the prior art. In particular, it would be desirable to provide a multiple roll tape dispenser which is relatively simple in construction and is capable of accommodating rolls of tape having varying inner and outer diameters and varying width. Furthermore, it would be desirable to provide such multiple roll tape dispenser that can be employed in horizontal, vertical and inclined positions. Still further, it would be desirable to provide a multiple roll tape dispenser that can be easily re-loaded, simple in construction and is relatively inexpensive to manufacture.

SUMMARY OF THE INVENTION

Accordingly, it is an object of the present invention to provide a tape dispensing system capable of simultaneously dispensing multiple rolls of tape having similar or varying inner and outer diameters and/or rolls of tape having similar or varying widths.

It is a further object of the invention to provide a multiple roll tape dispenser that can be easily reloaded.

It is an even further object of the invention to provide a multiple roll tape dispenser that is simple in construction and relatively inexpensive to manufacture.

Other objects will in part appear hereinafter. The invention accordingly, comprises the features of construction, combination of elements and arrangements of parts, which will be exemplified in the following detailed description and the scope of the invention will be indicated in the claims.

According to one aspect of the invention, a multiple roll tape dispensing system is provided for dispensing at least one first tape having a first inner diameter and at least one second tape having a second inner diameter which is greater than the first inner diameter. The dispensing system consists of a spool housing assembly and a spool unit. The spool unit which is operatively connected to the spool housing assembly includes a first end cap operatively connected to a second end cap by at least one inner cross member for rotatably supporting the first tape roll and at least two outer cross members for rotatably supporting the second tape roll. The base unit is provided operatively connected to the spool housing assembly and formed with a securing arrangement for securing the system to the work surface.

As to another aspect of the invention, the tape dispensing system includes at least one spacer for operatively separating the first roll of tape and the second roll of tape, wherein the spacer includes a plurality of apertures allowing the inner cross members or outer cross members to pass therethrough.

As to a further aspect of the invention, the spool housing assembly consists of at least one clamping mechanism for releasably securing the spool unit. At least one end cap includes a detent abutment adapted for cooperation with at least one clamping mechanism, so as to prevent rotational movement of the spool unit relative to the housing assembly, when the spool unit is operatively connected to the spool housing assembly. The clamping mechanism further includes a guiding trough for operatively guiding the spool unit during positioning thereof within the spool housing assembly.

As to still another aspect of the invention, the at least one first tape roll is surrounded by the outer cross members. The outer cross members define an inner maximum diameter within the spool unit and the at least one first tape roll has an outer peripheral diameter that is less than the inner maximum diameter formed by the outer cross members.

According to still another aspect of the invention, an adjustable multiple roll tape dispensing system is provided for dispensing a plurality of tape rolls having varying inner and outer diameters and/or varying widths. The adjustable system includes a spool housing assembly and a spool unit. The spool unit consists of a first end cap and a second end cap which are operatively connected by a plurality of cross members. Each first and second end cap is formed with an adjustable arrangement, so that positioning of the plurality of cross members relative to the end caps may be adjusted inward and outward by the adjustment arrangement to rotatably accommodate the plurality of tape rolls. The adjustment arrangement includes a plurality of corresponding regularly spaced receiving apertures formed within the first and second caps. The receiving apertures are adapted to receive the plurality of cross members.

According to still a further aspect of the invention, at least one spacer is provided for operatively separating the plurality of tape rolls. The spacer is formed with an auxiliary adjustment arrangement for adjusting positioning of the cross members passing therethrough. The auxiliary adjustment arrangement includes a plurality of apertures corresponding to the receiving apertures of the adjustment arrangement.

According to yet another aspect of the invention, the plurality of cross members further comprises a plurality of inner and outer cross members. The outer cross members define an inner maximum diameter within the spool, so that at least one tape roll has an outer peripheral diameter that is less than the inner maximum diameter formed by the outer cross member. According to yet a further aspect of the invention the spool housing assembly further includes at least one clamping mechanism for releasably securing the spool unit. The at least one end cap includes a detent abutment adapted for cooperation with the clamping mechanism, so as to prevent rotational motion of the spool unit relative to the spool housing assembly. The clamping mechanism further includes a guiding trough for operatively guiding the spool unit into the spool housing assembly.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

For purpose of illustration, and not to limit generally, the present invention will now be described with specific reference to FIGS. 1–16. It is noted that the drawings of the invention are intended to depict only typical embodiments of the invention, are not necessarily to scale and are merely schematic representations, not intended to portray specific parameters of the invention. The invention will now be described with additional specificity and detail through the accompanying drawings.

Figure 1:
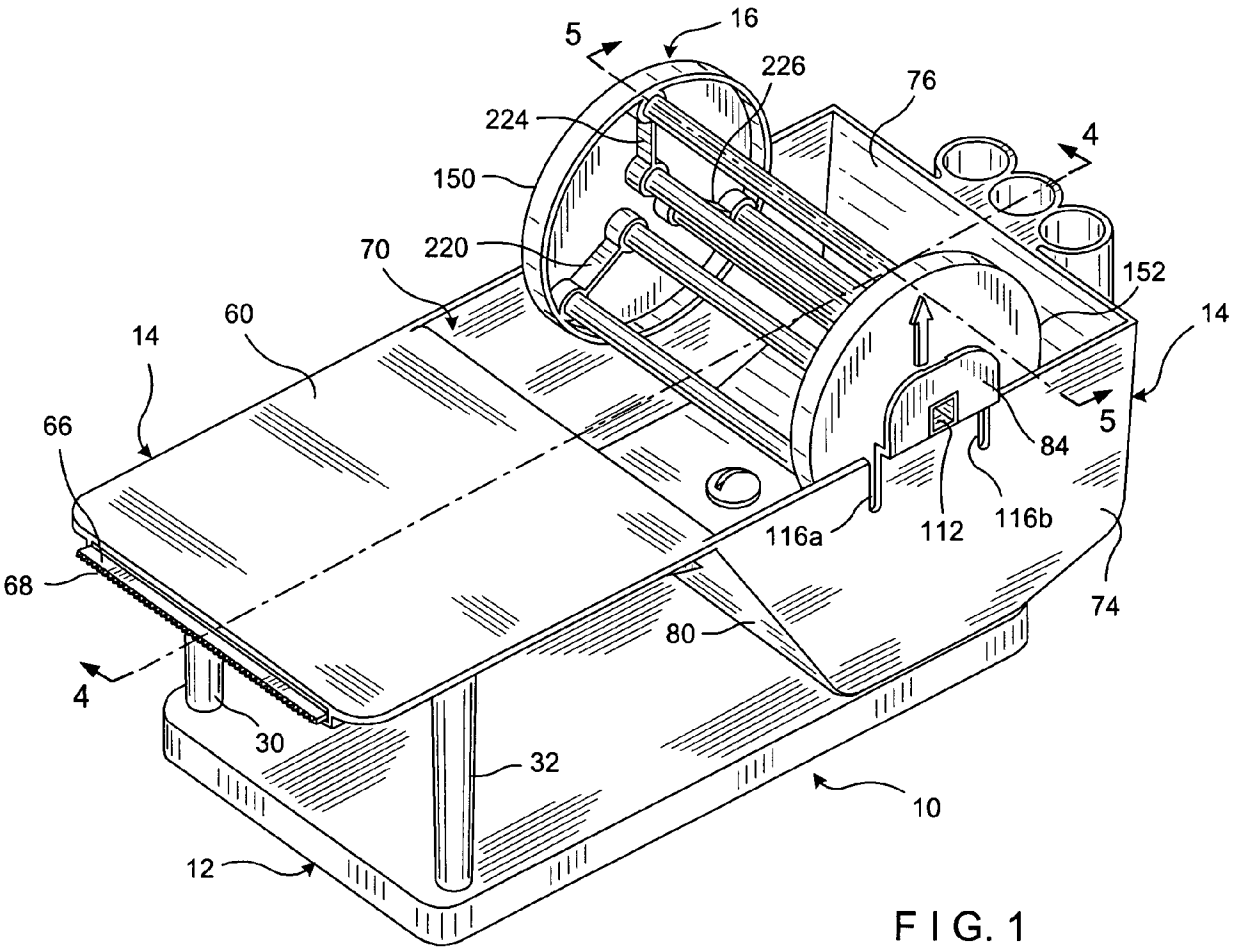
FIG. 1 is a perspective view showing a multiple roll tape dispensing system in accordance with one embodiment of the present invention.

With reference to the Figures, wherein like numerals reference like or corresponding parts throughout the several views, FIG. 1 shows a representative embodiment of a multiple roll tape dispensing system 10. The multiple roll tape dispensing system 10 includes a base unit 12, a spool housing assembly 14 and a spool unit 16. While the multiple roll tape dispensing system 10 is particularly suitable for dispensing multiple rolls of pressure sensitive adhesive tape, utilization of the system with other types of tape is also contemplated.

Figure 2:
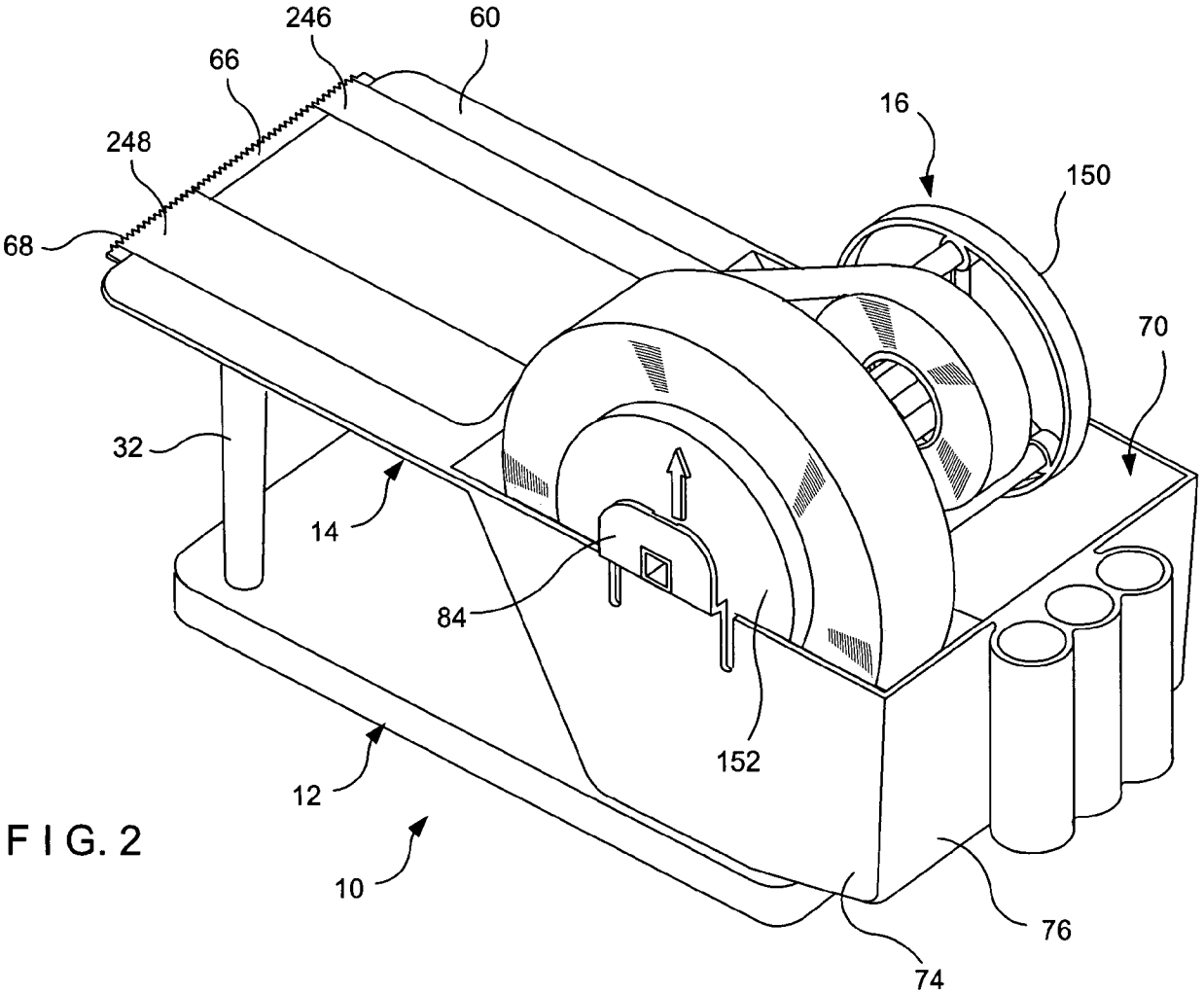
FIG. 2 is a perspective view of the multiple roll tape dispensing-system of FIG. 1 showing the tape dispenser loaded with rolls of tape.
Figure 3:
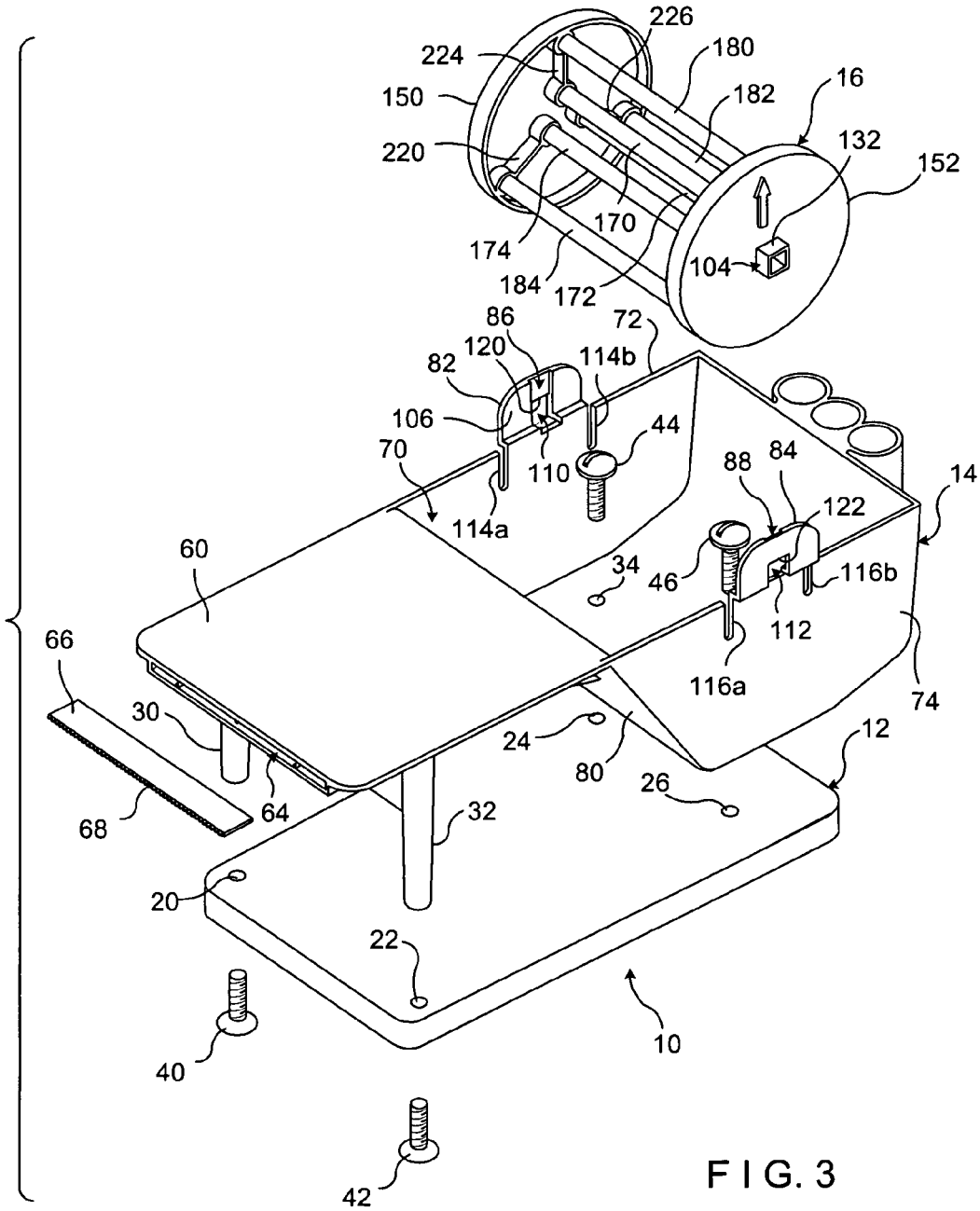
FIG. 3 is an exploded perspective view of the multiple roll tape dispensing system showing a spool unit.

As illustrated in FIGS. 2 and 3, the base unit 12 can be of a substantially rectangular configuration and is preferably molded of a plastic material. It should be noted however, that the base unit 12 can be of any conventional configuration and made of any suitable material. To facilitate attachment of the spool housing assembly 14 to the base unit 12 multiple, or at least four openings 20, 22, 24 and 26 are preferably formed within the base unit 12. The openings 20, 22 are positioned to correspond with a pair of support legs 30, 32, on the spool housing assembly 14, which can be internally threaded. The openings 24, 26 are positioned to correspond with a respective pair of openings 34 in the spool housing assembly 14.

A first set fasteners 40, 42 pass through the openings 20, 22 and are adapted for engagement with support legs 30, 32. As depicted, a second set of fasteners 44, 46 pass through openings 34 and into the openings 24, 26 of the base unit 12. In the embodiment of FIG. 3 the fasteners 40, 42, 44, 46 are of the screw type which are threaded into the respective elements. It should be noted, however, that the attachment between the spool housing assembly 14 and the base unit 12 could be accomplished by means of rivets, adhesive or any other conventional fastening techniques. In addition, the spool housing assembly 14 and the base unit 12 could be molded into a unitary structure during the manufacturing process.

FIG. 1 shows the base assembly 12, the spool housing assembly 14 and the spool unit 16 assembled together. As shown most clearly in FIG. 4, a pair of attachment brackets 50, 52 can be provided within the base 12. Such brackets in combination with a pair of mechanical fasteners 54, 56 (shown in phantom), may be used to connect the base 12 to any suitable work surface 58. It should be noted that other methods of securing the base 12 to a workbench, wall or other work surface, such as suction cups, Velcro or other mounting means are contemplated. Also, in certain embodiments, multiple roll tape dispensing system 10 may be left free standing and unattached to a work surface. In addition, it is contemplated that spool housing assembly 14 may be directly fixed to a work surface without the base.

The spool housing assembly 14 includes an upper surface 60 having a lip 62 that further includes a slotted opening 64 for receiving a tape-cutting member 66. Preferably the tape-cutting member 66 is formed from a single die cut metal sheet and includes a serrated cutting edge 68. Alternatively, the serrated cutting edge 68 may be fabricated using other methods or materials such as plastic. It is also contemplated that a serrated tape-cutting edge may be integrally formed within the lip 62 or otherwise incorporated into the spool housing assembly 14.

Figure 4:
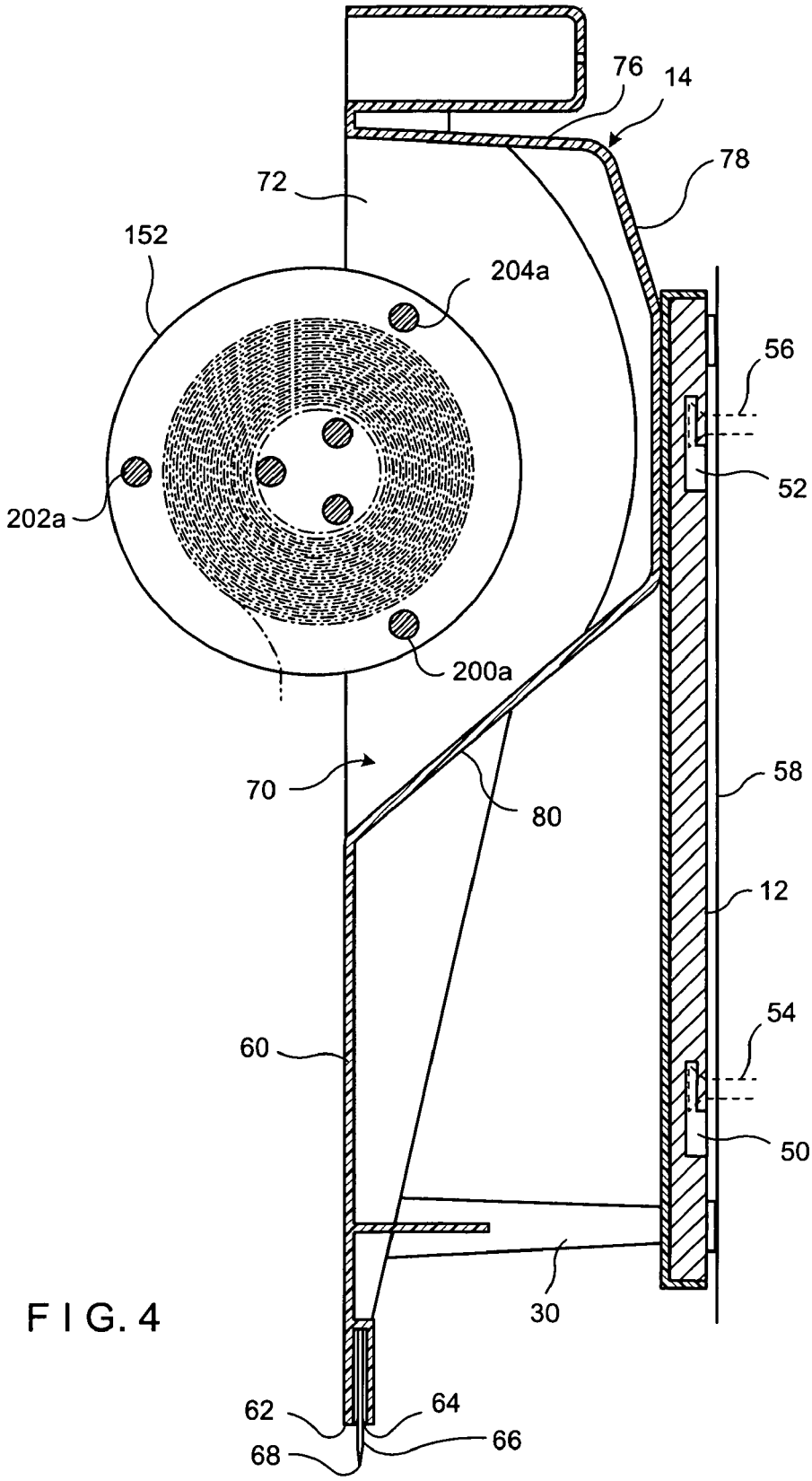
FIG. 4 is an enlarged cross-sectional view of the multiple roll tape dispensing system taken along section line 4—4 of FIG. 1 and showing the system in a vertical position.

A spool well 70, for receiving the spool unit 16, is formed at one end of the spool housing assembly 14. The spool well 70 is substantially formed by a pair of spaced wall portions 72, 74 that are joined by a rear wall portion 76, a bottom wall portion 78 and a front wall portion 80. As best shown in FIGS. 3 and 4 the side wall portions 72, 74 are substantially straight and extend substantially parallel to each other, while the connecting rear wall portion 76, the bottom wall portion 78 and the front wall portion 80 are shown somewhat sloped or curved to form a continuous inner surface.

As best illustrated in FIGS. 1, 2, 3 and 5, spool housing assembly 14 is equipped with a pair of hinged clamping mechanisms 82, 84 that are associated with the side wall portions 72, 74 and which act as the primary means of releasably retaining the spool unit 16 within the spool well 70. Hinged clamping mechanisms 82, 84 include guiding troughs 86, 88, which help guide the spool unit 16 into the spool well 70 by aligning with a pair of detent abutments 102, 104 on the spool unit 16.

In one embodiment of the invention (see FIG. 3, for example), guiding troughs 86, 88 culminate in a pair of substantially rectangular apertures 110, 112, which ultimately secure the spool unit 16 to the spool housing assembly 14. In addition to releasably securing the spool unit 16 to the spool housing assembly 14, the substantially rectangular apertures 110, 112 prevent the spool unit 16 from rotating when seated. To ensure a substantially tight alignment between spool unit 16 and spool housing assembly 14, the substantially rectangular apertures 110, 112 of hinged clamping mechanisms 82, 84 preferably have an internal periphery corresponding to the outer periphery of the detent abutments 102, 104.

Figure 5:
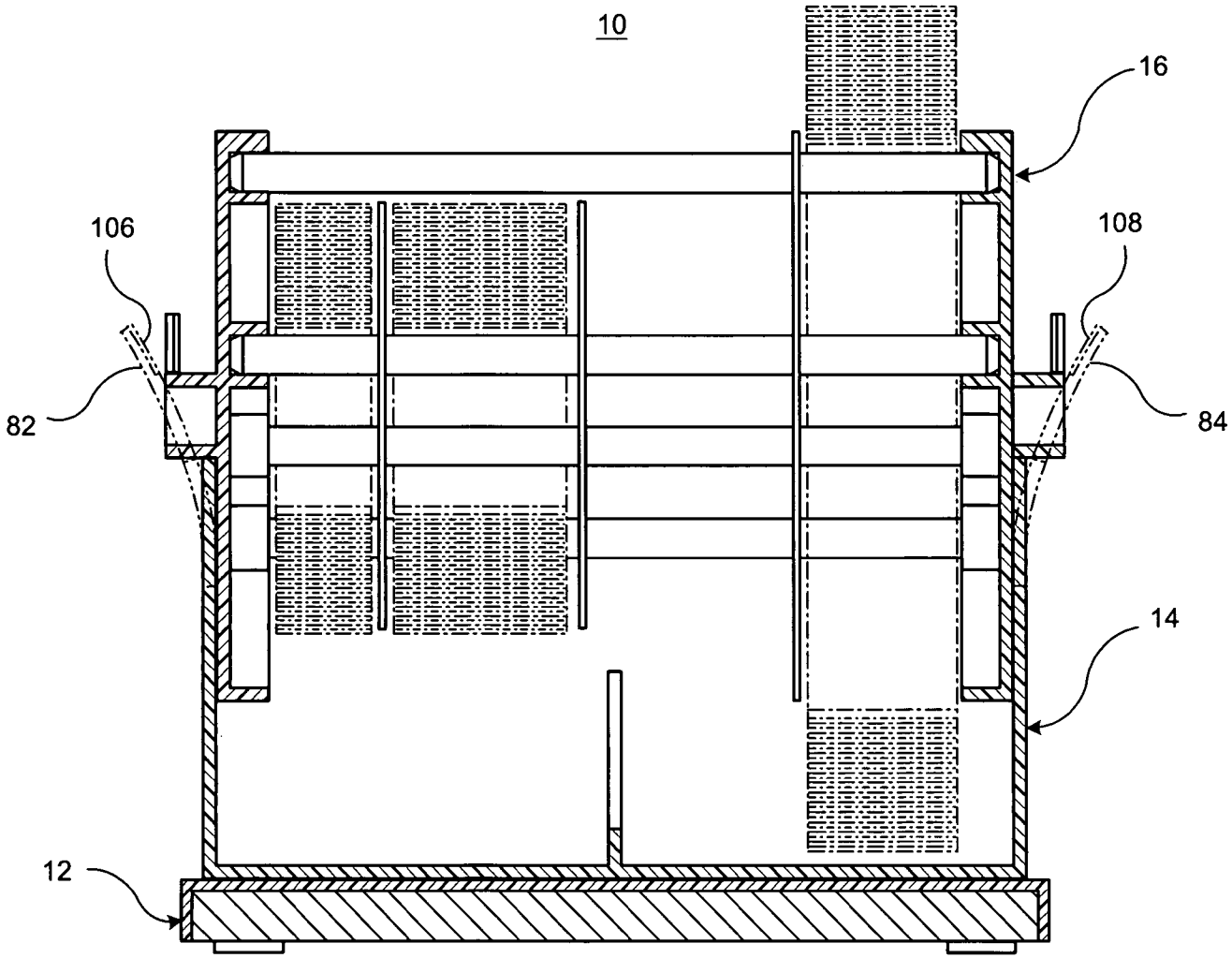
FIG. 5 is an enlarged cross-sectional view of the multiple roll tape dispensing system taken along section line 5—5 of FIG. 1 and showing the system in operation with multiple rolls of tape having varying inner and outer diameters and varying widths.
Figure 7:
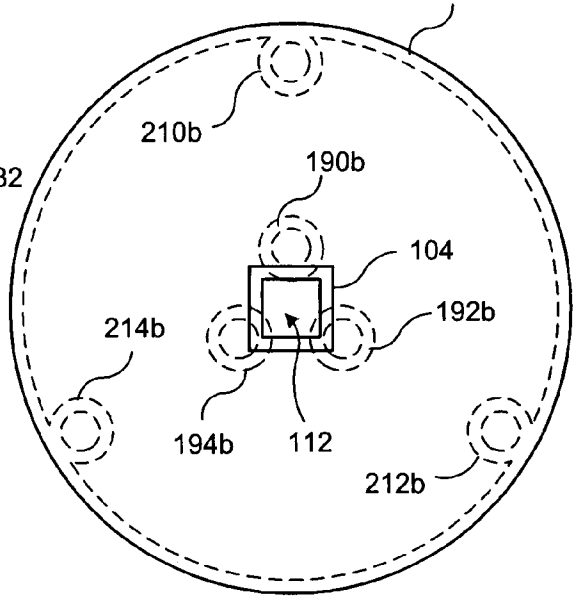
FIG. 7 is a side elevational view of an end cap of the spool unit of FIG. 6.

In order to releasably retain spool unit 16 in spool housing assembly 14, the hinged clamping mechanisms 82, 84 are ramped apart from one another, as shown most clearly in FIG. 5. This is accomplished by pressing against contact surfaces 106, 108 of clamping mechanisms 82, 84, thereby allowing detent abutments 102, 104 to slide down through guiding troughs 86, 88 and into substantially rectangular or square apertures 110, 112. In the present embodiment, hinged clamping mechanisms 82, 84 are preferably fabricated from a flexible material such as plastic. In addition, a set of pairs of substantially vertical extending slits 114*a*, 114*b* and 116*a*, 116*b*, is formed within side wall portions 72, 74. This arrangement provides additional flexibility to hinged clamping mechanisms 82, 84, facilitating loading and unloading of the spool unit 16.

After the spool unit 16 is fully seated in spool well 70, the hinged clamping mechanisms 82, 84 snap back into place and a pair of top surfaces 120, 122 of square apertures 110, 112, engage a pair of top surfaces 130, 132 of detent abutments 102, 104, releasably secure the spool unit 16. The spool unit 16 may be released form the spool housing assembly 14 by pressing against contact surfaces 106, 108 of clamping mechanisms 82, 84, thereby disengaging them from top surfaces 130, 132 of detent abutments 102, 104. Although the present invention is described with reference to a pair of clamping mechanisms 82, 84, it should be noted that this similar functionality could be achieved by an embodiment with a single clamping mechanism associated with one side wall of the housing (not shown). In this embodiment only one detent abutment at the end cap of the spool unit is needed. The opposite end cap should be only nominally supported by the side wall of the housing formed without the clamping mechanism.

As depicted in FIGS. 1–10, the detent abutments 102, 104 and the apertures 110, 112 are of a substantially rectangular configuration. It should be noted, however, that various types of abutment and aperture configurations are contemplated for releasably securing the spool unit 16 to the spool housing assembly 14. For example, in an alternative embodiment of the present invention, a pair or a single triangular detent abutments 140 is provided for this purpose, (see the embodiment of FIG. 13).

As shown most clearly in FIGS. 6 through 12, the spool unit 16 is designed to rotatably support a plurality of tape rolls. The spool unit 16 includes a pair of end caps 150, 152, which are of a substantially round configuration and include outer surfaces 154, 156 and inner surfaces 158, 160. Included on the outer surfaces 154, 156 are the detent abutments 102, 104, which may be integrally formed with end caps 150, 152, or may be mechanically or adhesively attached thereto.

In the preferred embodiment, end caps 150, 152 are operatively connected by a series of inner cross members 170, 172, 174 and a series of outer cross members 180, 182, 184. The inner cross members 170, 172, 174 are inserted into corresponding inner receiving apertures 190*a*, 192*a*, 194*a* and 190*b*, 192*b*, 194*b*, which are preferably evenly spaced and located equidistantly from the centers of the respective end caps 150, 152. Similarly, outer cross members 180, 182, 184 are inserted into corresponding outer receiving apertures 210*a*, 212*a*, 214*a* and 210*b*, 212*b*, 214*b*, which are also preferably evenly spaced and located around the outer periphery of the respective end caps 150, 152. The inner and outer receiving apertures are preferably integrally formed within the respective inner surfaces 158, 160 and may be connected by a series of integrally formed radial spoke arms 220,224,226 (see FIGS. 1 and 3), which provide additional rigidity and strength to end caps 150, 152.

Figure 6:
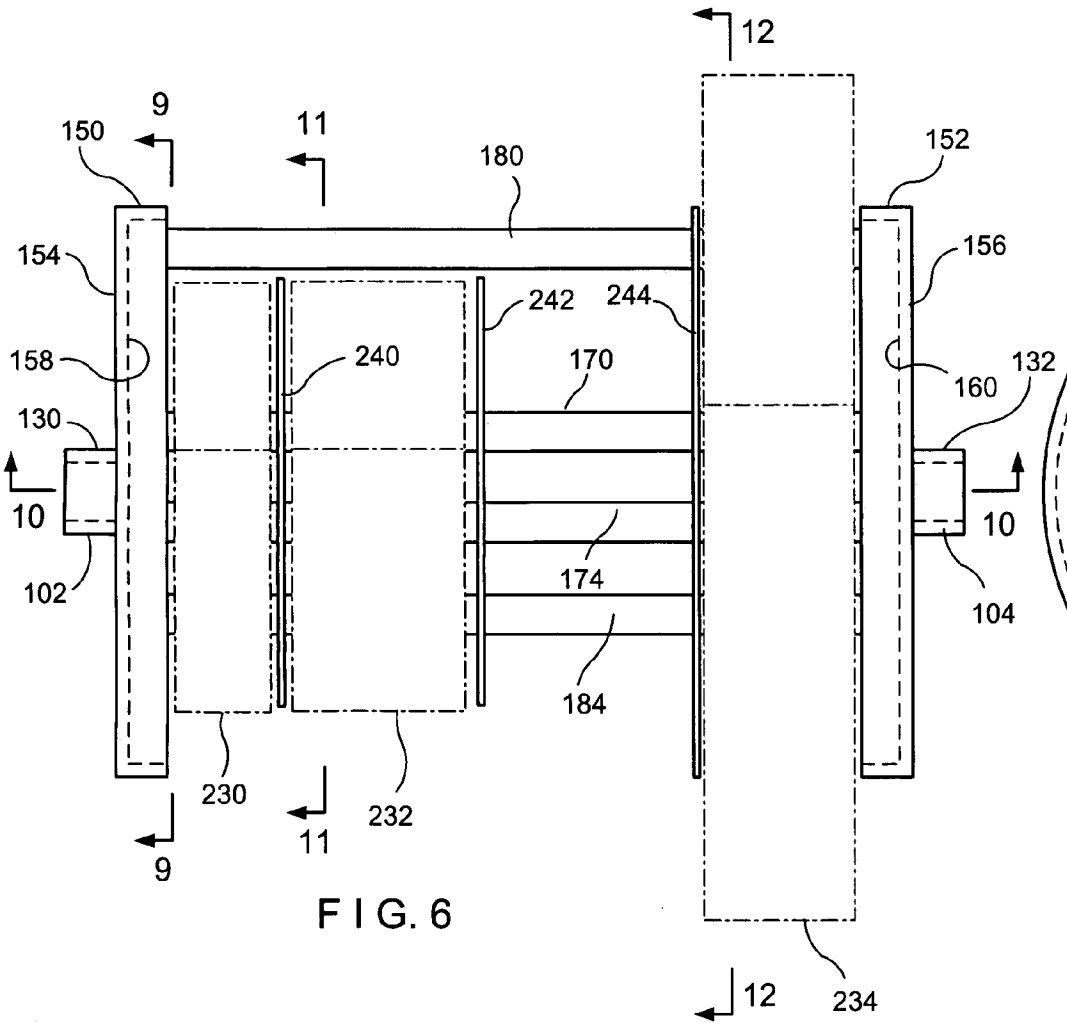
FIG. 6 is a front elevational view of a spool unit of the multiple roll tape dispensing system showing the spool unit in operation.
Figure 9:
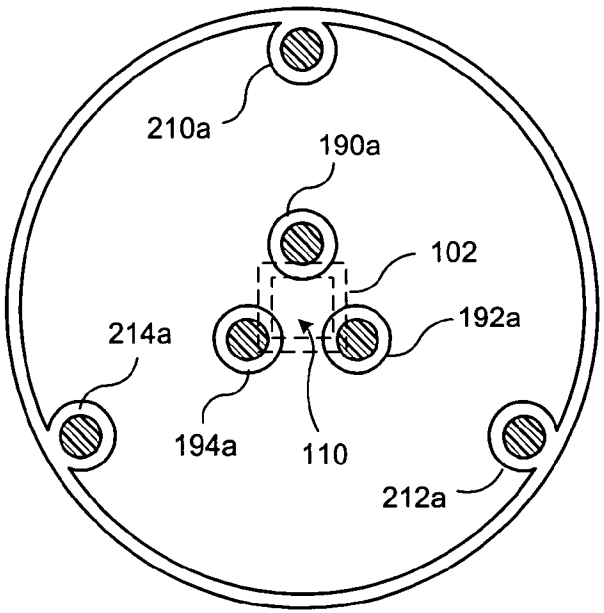
FIG. 9 is a cross-sectional view of the of the spool unit taken along section line 9—9 of FIG. 6.
Figure 8:
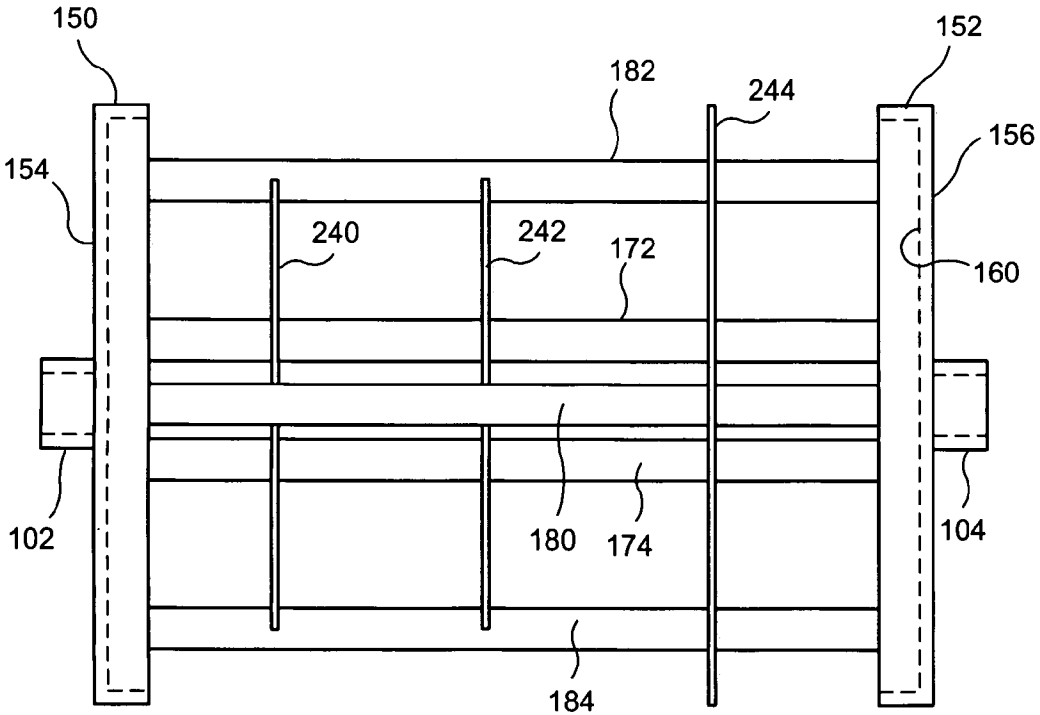
FIG. 8 is a front elevational view of a spool unit of the multiple roll tape dispensing system.
Figure 11:
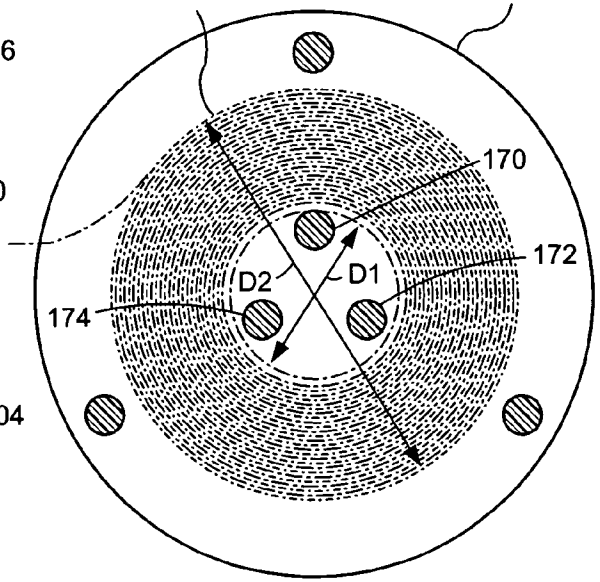
FIG. 11 is a cross-sectional view of the of the spool unit taken along section line 11—11 of FIG. 6.
Figure 10:
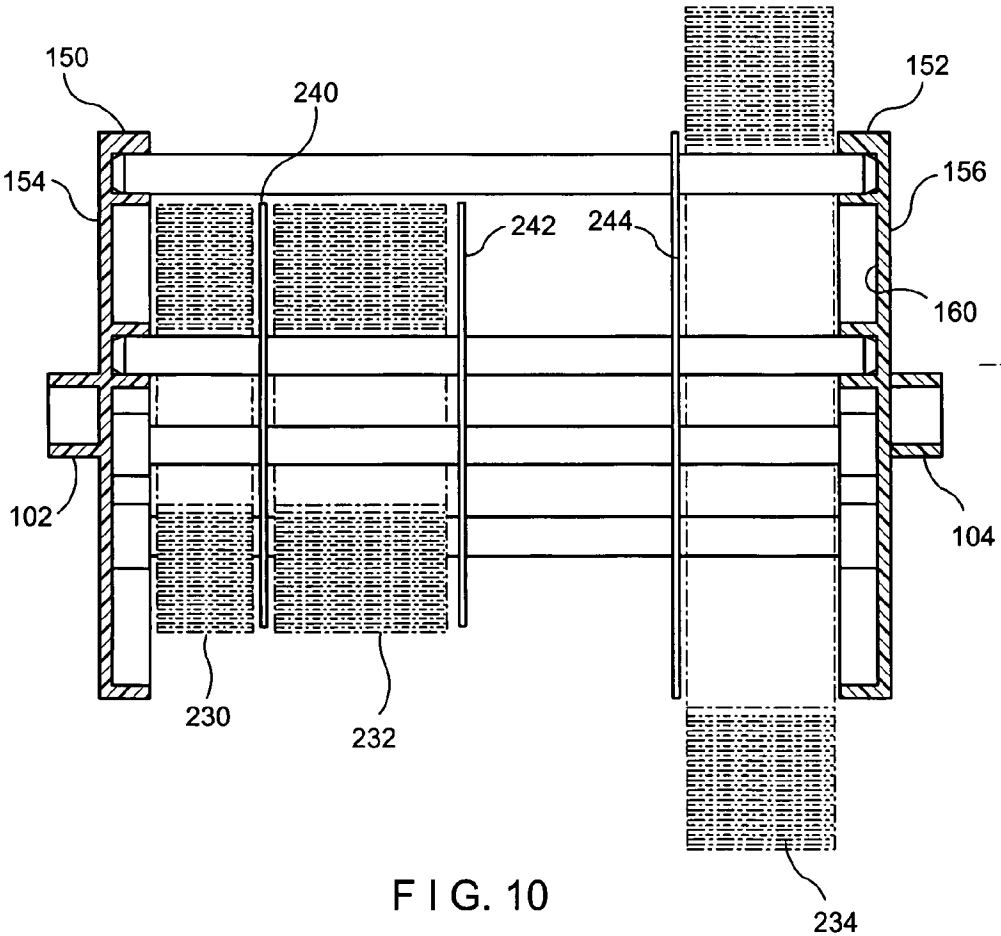
FIG. 10 is a cross-sectional view of the of the spool unit taken along section line 10—10 of FIG. 6.
Figure 13:
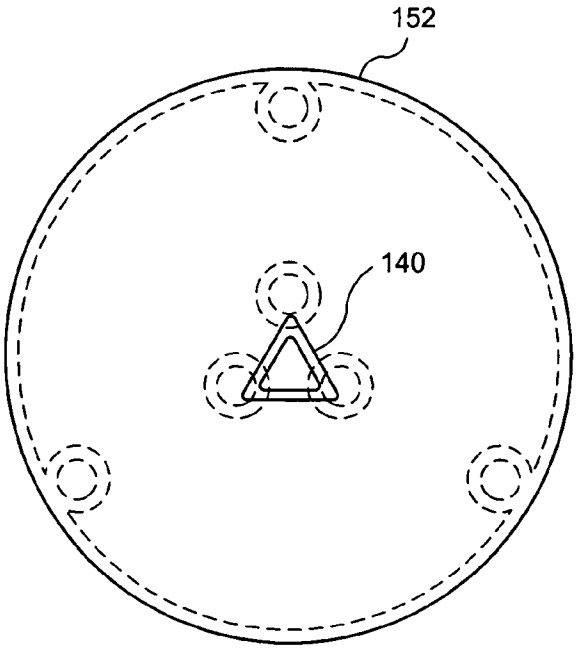
FIG. 13 is a side elevational view of an end cap of a spool unit in accordance with a further embodiment of the present invention.
Figure 12:
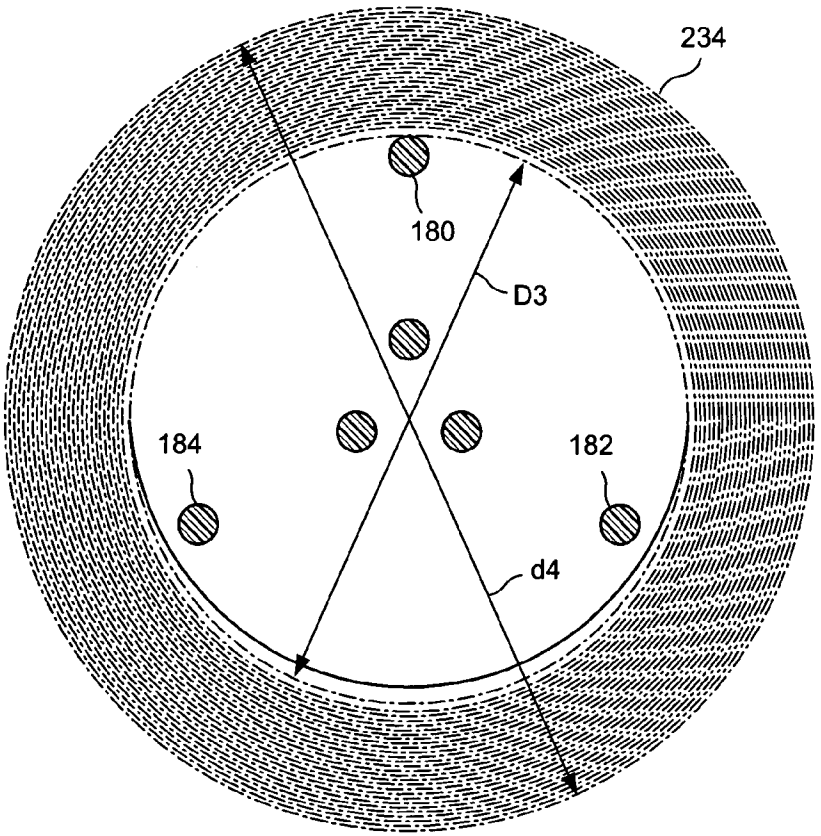
FIG. 12 is a cross-sectional view of the of the spool unit taken along section line 12—12 of FIG. 6.

Significantly, in addition to operatively connecting end caps 150, 152, the inner and outer cross members operate to rotatably support a plurality of rolls of tape having varying configurations and dimensions. Reverting back to FIGS. 5 and 6, three rolls of tape 230, 232, 234 are shown loaded on the spool unit 16. It should be noted that each of the three rolls of tape 230, 232, 234 may differ in width and or inner or outer diameters. The inner rolls of tape 230 and 232 have similar inner diameters D1 and outer diameters D2 (see FIG. 11) and are rotatably supported on inner cross members 170, 172, 174 of spool unit 16. The outer roll of tape 234 has larger inner diameter D3 and outer diameter D4 (see FIG. 12) than the respective diameters D1 and D2 of the other two rolls of tape 230, 232. The outer roll of tape 234 is rotatably supported by outer cross members 180, 182, 184. As best illustrated in FIG. 6, the inner rolls of tape 230, 232 having smaller inner and outer diameters D1 and D2 are rotationally supported by the inner cross members 170, 172, 174. In order to protect the inner rolls of tape 230, 232 from damage during operation of the device of the invention, these rolls of tape are surrounded by the outer cross members 180, 182, 184. In this arrangement the outer cross members limit the maximum outer peripheral diameter for the inner rolls of tape 230, 232 within the spool unit 16. In this respect, the inner rolls of tape 230, 232 have the outer peripheral diameter D2 which is less than the inner maximum diameter formed by the outer cross members 180, 182, 184.

Figure 14:
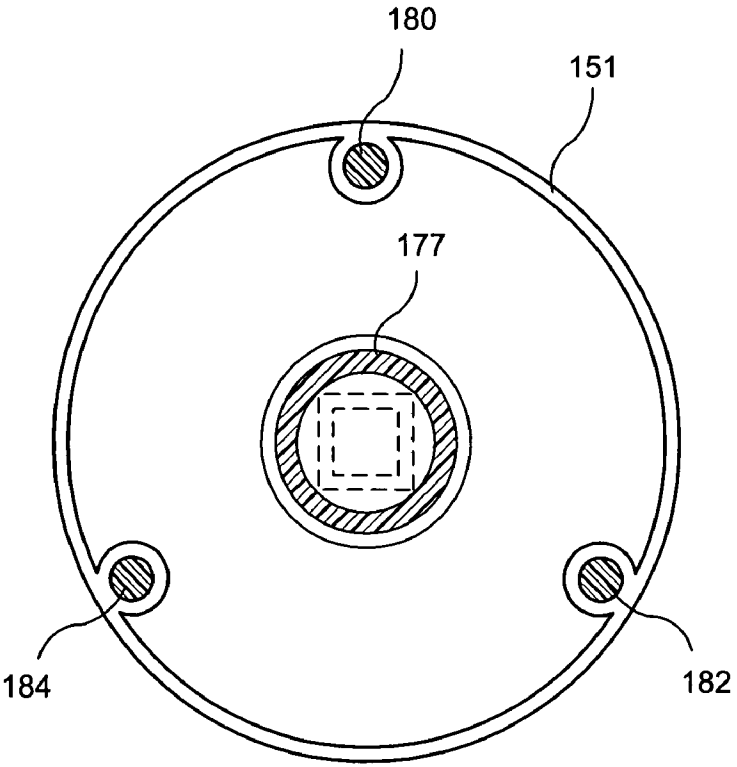
FIG. 14 is a side elevational view showing a modified spool unit.

Referring now to FIG. 14, showing an alternative embodiment of the spool unit in which the end caps 151 are operatively connected by a series of outer cross members 180, 182, 184 and a single inner cross member 177 which extends between the central regions of the end caps. Such single inner cross member 177 can be in the form of substantially hollow, tube-shaped element having an outer diameter adapted to rotatably receive the inner diameter D1 of the inner tape rolls, 230, 232.

In operation, to load or unload a roll of tape from the spool unit 16, the respective end cap is removed and the core of a roll of tape is slid on over the corresponding cross members. A series of spacing disks 240, 242, 244 may be placed between the rolls of tape, so as to allow the rolls of tape to rotate freely and dispense the respective tape without interference from an adjacent roll. As shown, spacing disks 240 and 242 are formed with apertures that correspond to and are adapted to receive the inner cross members. On the other hand, a spacing disk 244 is formed with apertures corresponding to and receiving both the inner and outer cross members. As shown most clearly in FIG. 2, to simultaneously dispense a section of tape from two rolls of tape, a leading edge 246, 248 of each tape roll is pulled over upper surface 60 of spool housing assembly 14 towards tape cutting member 66 where they are severed from their respective tape rolls on serrated cutting edge 68.

Figure 16:
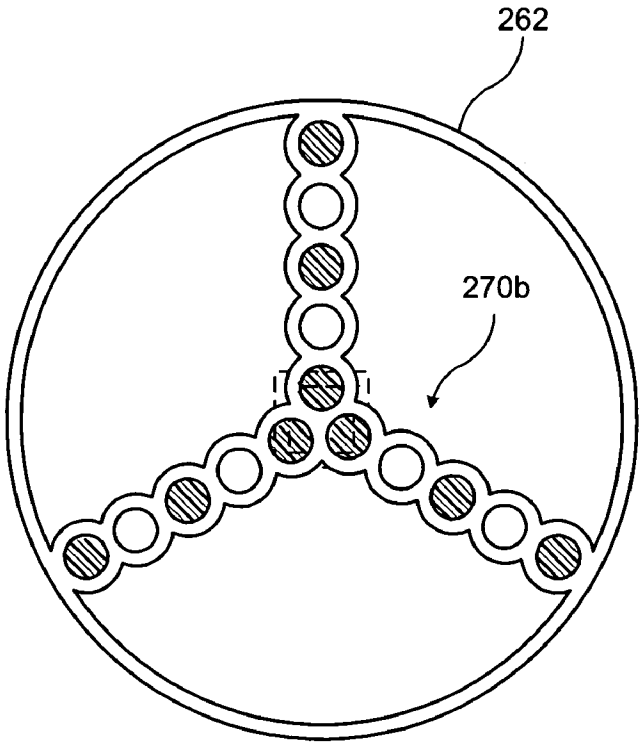
FIG. 16 is a side elevational view of an end cap of the adjustable spool unit.
Figure 15:
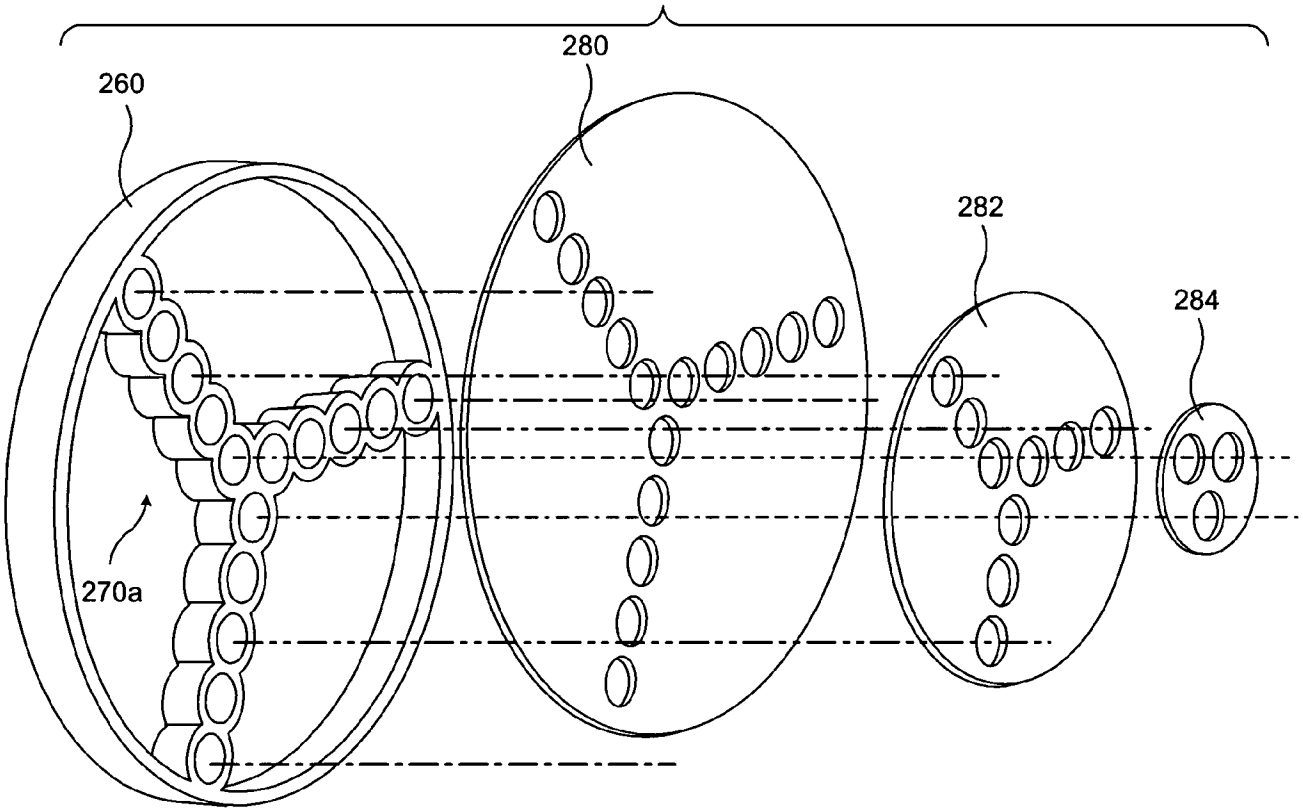
FIG. 15 is an exploded perspective view of an adjustable spool unit in accordance with another embodiment of the present invention.

Referring now to FIGS. 15 and 16, wherein an alternative embodiment of the present invention is shown. In this embodiment, the spool unit includes a pair of end caps 260, 262, each formed with an adjustment arrangement enabling a radial adjustment of positioning of the inner and outer cross members relative to the respective caps. The adjustment arrangement can be in the form of a multiplicity of corresponding receiving apertures 270*a*, 270*b* radially or evenly distributed on the interior of the caps. Thus, multiple series of cross members (not shown) may be inserted into corresponding receiving apertures on end caps 260, 262. In this embodiment of the invention, the position of each cross member can be adjusted, to accommodate rolls of tape having various inner and outer diameters. For example, in this embodiment three or more sets of tape rolls having various inner and outer diameters can be accommodated. Similar to the spacing disks in the previous embodiment, a series of spacing disks 280, 282, 284 may be placed between rolls of tape to allow them to rotate freely and dispense the respective tape without interference from an adjacent roll. The spacing discs 280, 282, 284 are formed with an auxiliary adjustment arrangement to accommodate adjustment of positioning of the cross members passing therethrough. As illustrated in FIG. 15, the auxiliary adjustment arrangement includes a plurality of apertures corresponding to the receiving apertures 270*a*, 270*b* on the end caps 260, 262.

Although the invention has been described with reference to the specific embodiments, those skilled in the art will recognize that changes can be made in the form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A roll tape dispensing system for dispensing at least one tape roll, the system comprising:

a spool housing assembly;

a spool unit supported by the spool housing assembly, the spool unit comprising a first end cap and a second end cap, the first end cap connected to the second end cap by a plurality of inner cross members and a plurality of outer cross members, wherein the plurality of inner cross members are configured to extend through a core of a tape roll and support the tape roll, and the plurality of outer cross members are configured to extend through a core of a tape roll and support the tape roll;

at least one tape roll supported by the plurality of inner cross members and disposed between an inner boundary defined by the inner cross members and an outer boundary defined by the outer cross members, wherein the at least one tape roll and the plurality of inner cross members are surrounded within the spool unit by the plurality of outer cross members, and a tape cutting member received by the spool housing assembly.

2. The 21 roll tape dispensing system according to claim 1, further comprising a base unit connected to the spool housing assembly and formed with a securing arrangement for securing the device to a work surface.

3. The roll tape dispensing system according to claim 1, wherein the plurality of outer cross members define an inner maximum diameter within the spool unit and wherein the at least one tape roll has an outer peripheral diameter that is spaced from and disposed within boundaries of the inner maximum diameter.

4. The roll tape dispensing system according to claim 1, further comprising a base unit connected to the spool housing assembly and including an attachment arrangement for securing the system to a work surface.

5. The roll tape dispensing system according to claim 1, wherein the at least one tape roll comprises at least one inner tape roll operatively supported by the plurality of inner cross members the system further comprising at least one outer tape roll operatively supported by the plurality of outer cross members.

6. The roll tape dispensing system according to claim 5, further comprising at least one spacer for operatively separating the at least one inner roll of tape and the at least one outer roll of tape, wherein the at least one spacer includes a plurality of apertures which allow the inner cross members or outer cross members to pass therethrough.

7. The roll tape dispensing system according to claim 5, wherein the inner cross members are tubular structures extending between central regions of the first end cap and the second end cap.

8. The roll tape dispensing system according to claim 5, wherein the spool housing assembly further comprises at least one clamping mechanism for releasably securing the spool unit.

9. The roll tape dispensing system according to claim 8, wherein at least one of the first end cap and the second end cap includes a detent abutment adapted for cooperation with the at least one clamping mechanism, so as to prevent rotational movement of the spool unit relative to the housing assembly when the spool unit is operatively connected to the spool housing assembly.

10. The roll tape dispensing system according to claim 8, wherein the at least one clamping mechanism further includes a guiding trough for operatively guiding the spool unit during positioning thereof within the spool housing assembly.

11. The roll tape dispensing system according to claim 5, wherein at least one additional roll of tape is rotatably supported by either the plurality of inner cross members or by the plurality of outer cross members.

12. The roll tape dispensing system according to claim 5, wherein positioning of the plurality of cross members relative to the end caps is adjustable and inward or outward by the adjustment arrangement to rotatably accommodate the inner and outer tape rolls.

13. The roll tape dispensing system, according to claim 12, wherein said adjustment arrangement includes a plurality of corresponding radially spaced receiving apertures formed within said first and second end caps, the receiving apertures are adapted to receive the plurality of cross members.

14. The roll tape dispensing system, according to claim 13, further comprising at least one spacer for operatively separating the inner and outer tape rolls, said spacer being formed with an auxiliary adjustment arrangement for adjusting positioning of said cross members passing therethrough.

15. The roll tape dispensing system, according to claim 14, wherein said auxiliary adjustment arrangement includes a plurality of apertures corresponding to the receiving apertures of the adjustment arrangement of the end caps.

16. The roll tape dispensing system, according to claim 12, wherein the spool housing assembly further comprises at least one clamping mechanism for releasably securing the spool unit.

17. The roll tape dispensing system, according to claim 16, wherein at least one of the end caps includes a detent abutment adapted for cooperation with the clamping mechanism, so as to prevent rotational motion of the spool unit relative to the spool housing assembly.

18. The roll tape dispensing system according to claim 16, wherein the at least one clamping mechanism further includes a guiding trough for operatively guiding the spool unit into the spool housing assembly.

* * * * *

UNITED STATES PATENT AND TRADEMARK OFFICE

CERTIFICATE OF CORRECTION

PATENT NO. : 6,974,060 B2
DATED : December 13, 2005
INVENTOR(S) : Francis Gomes et al.

It is certified that error appears in the above-identified patent and that said Letters Patent is hereby corrected as shown below:

Column 8,
Lines 17-18, should read -- 2. The [21] roll tape dispensing system according to claim --.

Signed and Sealed this

Twenty-eighth Day of February, 2006

JON W. DUDAS
*Director of the United States Patent and Trademark Office*